US009410776B1

(12) United States Patent
Hill

(10) Patent No.: US 9,410,776 B1
(45) Date of Patent: Aug. 9, 2016

(54) ARROW FLETCHING APPARATUS

(71) Applicant: Daniel Jones Hill, Commerce, GA (US)

(72) Inventor: Daniel Jones Hill, Commerce, GA (US)

( * ) Notice: Subject to any disclaimer, the term of this patent is extended or adjusted under 35 U.S.C. 154(b) by 0 days.

(21) Appl. No.: 14/741,401

(22) Filed: Jun. 16, 2015

(51) Int. Cl.
*F42B 6/06* (2006.01)

(52) U.S. Cl.
CPC ..... *F42B 6/06* (2013.01)

(58) Field of Classification Search
CPC ..... F42B 6/06
See application file for complete search history.

(56) References Cited

U.S. PATENT DOCUMENTS 2,887,319 A * 5/1959 Lay ..... F42B 6/06 473/586
3,815,916 A * 6/1974 Meszaros ..... F42B 6/06 273/DIG. 4
4,204,307 A 5/1980 Pfetzing
5,427,385 A * 6/1995 Conrad ..... F42B 6/06 473/586
7,331,886 B2 2/2008 Morris et al.
7,758,457 B2 * 7/2010 Marshall ..... F42B 6/06 473/586
7,874,947 B1 1/2011 Wolfinbarger et al.
7,892,119 B2 * 2/2011 Marshall ..... F42B 6/06 473/586
7,955,201 B2 6/2011 Harwath et al.
8,465,384 B2 6/2013 Blosser et al.
8,870,691 B2 10/2014 Marshall
9,046,329 B2 6/2015 Blosser et al.

* cited by examiner

*Primary Examiner* — John Ricci

(57) ABSTRACT

An arrow fletching apparatus for use in the sport of archery is provided. The fletching apparatus is used in place of conventional fletching and provides for adjustability and easy replacement of the apparatus itself or individual fletches in the field. The fletching apparatus comprises a body and a plurality of fletches. The body is kept in place on the arrow shaft by a friction fit and the fletches are likewise kept in place within a slot on the body by a friction fit.

14 Claims, 4 Drawing Sheets

ARROW FLETCHING APPARATUS

BACKGROUND OF THE INVENTION

1. Field of the Invention

The present invention relates generally to archery, and specifically to adding fletches to arrows.

2. Description of the Related Art

The sport of archery is one where consistency leads to accuracy and accuracy leads to success. Serious archers can spend countless hours perfecting their equipment with the end goal of precise repeatability for each and every shot. Arrows themselves can quickly become a source of inconsistency if care is not taken to properly build them from raw shafts. Fletches are one of the most important components of an arrow in that they must be light enough to not upset the balance of the arrow, and they must provide an appropriate amount of drag and spin to stabilize the arrow.

Generally, fletches comprise a planar flight control surface and a flanged base approximately perpendicular to the planar flight control surface and are attached to arrow shafts using an adhesive while held in place by a specialized device known as a fletching jig as the adhesive sets. The task of fletching arrows is a tedious one which takes several minutes per arrow, depending on the type of adhesive and type of fletching jig used. Common problems include poor adhesion and misalignment, which, to properly repair the arrow, both require stripping the fletch from the arrow and restarting the process.

In addition, the fletching jig must also be maintained to ensure consistent performance. Adhesives and residue must be cleaned from the jig regularly to prevent misalignment issues and to prevent the jig from adhering to the arrow or to the fletches themselves.

The task of fletching arrows is generally performed indoors at a desk or table. If any fletching problems occur in the field, the archer is forced to use another arrow and is usually limited to the arrows he has on his person. This is especially prevalent in competitions where several archers may shoot at the same target, and it is common for one arrow to damage the fletches of another. Other common instances that result in fletch damage are: improper storage, an arrow passing through a target, shooting through heavy brush, and fletches scraping against the ground or other object.

Furthermore, many arrow shafts are known to have different flight characteristics depending on their rotation angle relative to the string. In order to determine the proper rotation angle, it is usually necessary to shoot several arrows and compare the points of impact. In order to maximize consistency from arrow to arrow, it is also necessary to align the fletches relative to this rotation angle. Normally, this task is relegated to only the most dedicated of archers as it involves much trial and error as well as refletching arrows, usually multiple times.

One attempt to enable a jigless fletch includes fletches attached to a piece of shrink tubing which slides over the shaft of an arrow, then heat is used to secure the tube into place. Another similar attempt involves a one piece fletch and tube which requires an adhesive to secure the tube into place. Both of these attempts do eliminate the need for a fletching jig but do require a secondary process and thus suffer from some of the other limitations of conventional fletching. Another attempt to solve these problems involves a one piece fletch assembly surrounded by an annular wing. This device is not permanently attached to the arrow shaft and thus is easily field replaceable, and it allows the archer to easily change the position of the device to maximize consistency. However, this device is subject to damage, and must be replaced when damage occurs. One other attempt to solve these problems includes a fletching assembly which attaches to the trailing or nock end of the arrow. This assembly screws into a standard insert which is secured to the arrow by an adhesive. This device has the advantage of easily replaceable individual fletches, but cannot be rotationally adjusted. Also, the additional weight of this assembly may upset the balance of the arrow, depending on the point weight attached to the leading or point end of the arrow.

Therefore, it is desirable to provide a fletching apparatus which enables easy installation, field replaceable fletches, adjustable position, and minimal added weight. Such an apparatus would save time and allow an archer to tune his arrows precisely, providing accuracy through consistency.

BRIEF SUMMARY OF THE INVENTION

The present invention allows an archer to quickly and easily install, replace, or adjust the fletching on the shaft of an arrow by providing a body which slides over the arrow shaft and holds the fletches. The fletches are removably attached to the body by loading into the leading edge of a slot which is formed in a protrusion on the body where the protrusion and slot are formed helically around the longitudinal axis of the body. The slot is formed such that typical commercially available fletches comprising a flanged base may be used, as well as specifically designed fletches where the flanged base extends approximately perpendicular to the planar flight control surface on one or both sides. A tight friction fit keeps the fletches within the slots. If a fletch is damaged or otherwise requires replacement, the fletch may be removed from the body with or without the use of tools.

Furthermore, the position and rotation of the body may be adjusted in order to tune a particular arrow. The body is generally held in place by a tight friction fit with the arrow shaft. Likewise to the fletches, if the body is damaged or otherwise needs replacement, it also may be removed from the arrow shaft with or without the use of tools.

Another embodiment of the present invention includes a stopper which is glued to the arrow shaft and provides a positive stop for the body. Arrows shot at high velocities which are utilizing the present invention may require the use of the stopper in order to keep the body from shifting upon impacting a target.

BRIEF DESCRIPTION OF THE DRAWINGS

The present invention is shown in the following Figures where.

DETAILED DESCRIPTION OF THE INVENTION

Figure 1:
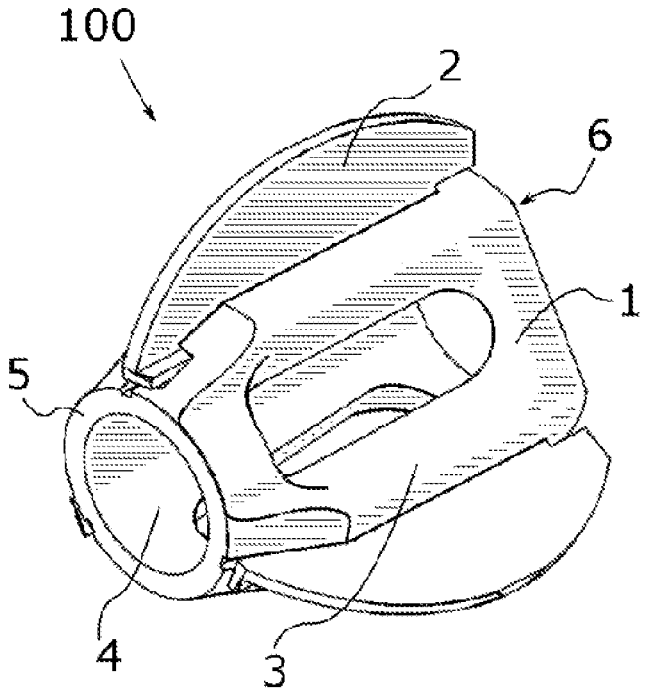
FIG. 1 is a perspective view of the assembled components of the preferred embodiment of the present invention.

In the preferred embodiment of the present invention, FIG. 1 shows fletching apparatus 100, including body 1 and a plurality of fletches 2. Body 1 comprises a plurality of protrusions 3 which are formed radially along the length of body 1 and a hole 4 which extends longitudinally through the center of body 1 and acts as an arrow shaft contacting surface. Body 1 is preferably formed of a stiff polymer such as ABS and may be formed by conventional means such as plastic injection molding and machining or other means such as fused deposition modeling or stereolithography. Fletching apparatus 100 further includes a leading or point edge 5 and a trailing or nock edge 6.

Figure 2:
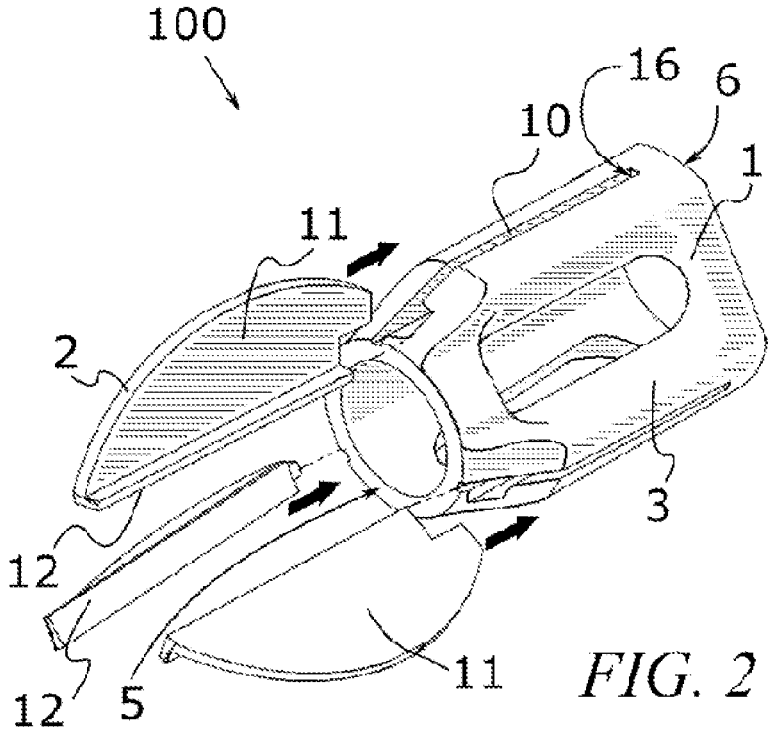
FIG. 2 is an exploded view showing the different components of the present invention in the preferred embodiment.

Referring to FIG. 2, body 1 comprises a plurality of protrusions 3 where each protrusion 3 comprises a slot 10 formed to accept a fletch 2. Fletch 2 is inserted into slot 10 by sliding along the longitudinal axis of body 1 toward the trailing edge 6. Similarly, fletch 2 is removed from slot 10 by sliding along the longitudinal axis of body 1 toward leading edge 5. Preferably, each fletch 2 in fletching apparatus 100 has a planar flight control surface 11 and a flanged base 12 which extends approximately perpendicular to the planar flight control surface 11 on one or both sides. Slot 10 is preferably formed to create a friction fit with planar flight control surface 11 and comprises a wider portion formed to create a friction fit with flanged base 12. Fletch 2 is fully seated into slot 10 once fletch 2 comes in contact with slot termination 16. Slot termination 16 near trailing edge 6 of body 1 prevents further movement of fletch 2 toward trailing edge 6 once fletch 2 is fully seated into slot 10.

Figure 3:
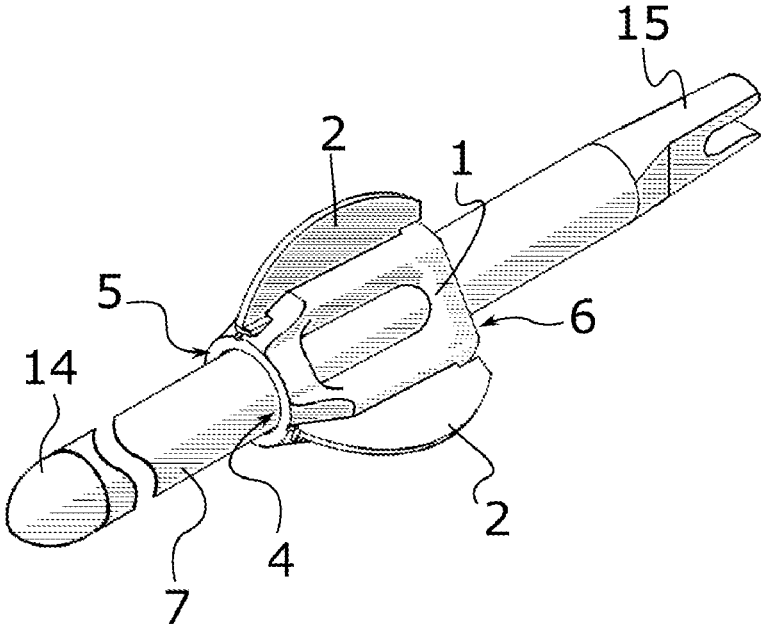
FIG. 3 is a perspective view showing the present invention in a preferred embodiment installed to the shaft of arrow.

As best shown in FIG. 3, body 1 of the preferred embodiment of the present invention is formed to removably dispose to arrow shaft 7. Preferably, hole 4 is formed such that its diameter is slightly larger than the diameter of arrow shaft 7 in order to easily slide body 1 over arrow shaft 7, with the difference in diameter small enough to create a friction fit between body 1 and arrow shaft 7. Preferably, once disposed to an arrow shaft, trailing edge 6 is oriented facing arrow nock 15 and leading edge 5 is oriented facing toward arrow point 14. Preferably, friction between body 1 and arrow shaft 7 is sufficient to keep body 1 in place relative to arrow shaft 7 during normal use.

Figure 4A:
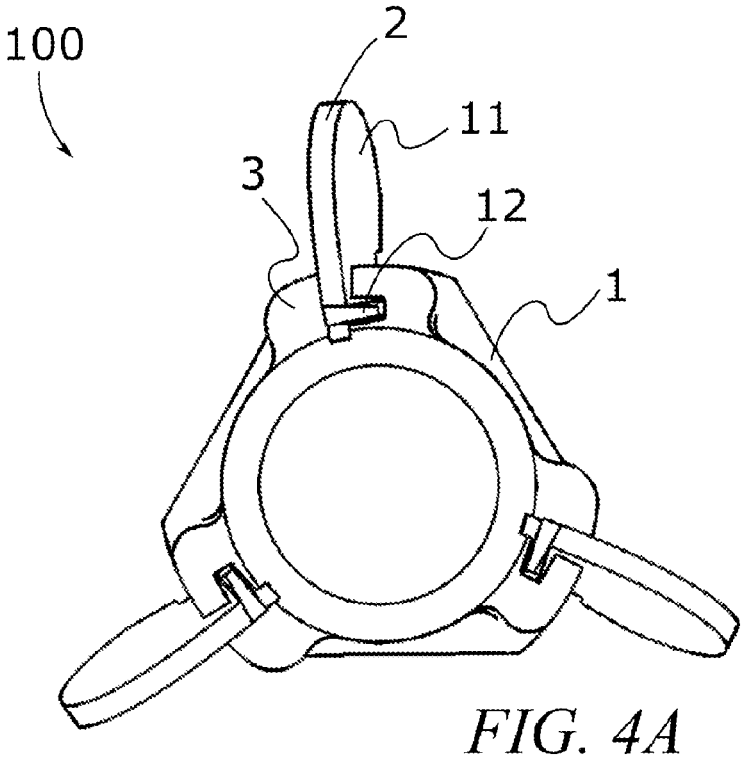
FIG. 4A is a front plan view of the present invention in a preferred embodiment.
Figure 4B:
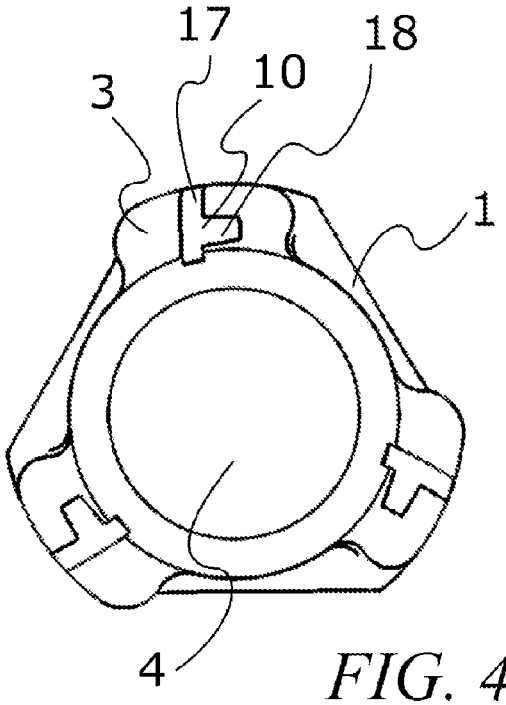
FIG. 4B is a front plan view of the body of the preferred embodiment.

As best shown in FIGS. 4A-4B, fletching apparatus 100 comprises a body 1 and a plurality of fletches 2, where body 1 comprises a plurality of protrusions 3, with each protrusion comprising a slot 10 which itself comprises a generally wide portion 18 and a generally narrow portion 17. Generally narrow portion 17 of slot 10 is adapted to engage planar flight control surface 11 of fletch 2. Generally wide portion 18 of slot 10 is adapted to engage flanged base 12 of fletch 2. Preferably, protrusions 3, and thusly, slots 10 are oriented helically about the center of hole 4. The helical orientation of slots 10 necessitate a helical orientation of fletches 2. During flight, a helical orientation of fletch 2 induces a pressure gradient over flight control surface 11, causing the arrow to spin and stabilize due to a gyroscopic effect.

Figure 5A:
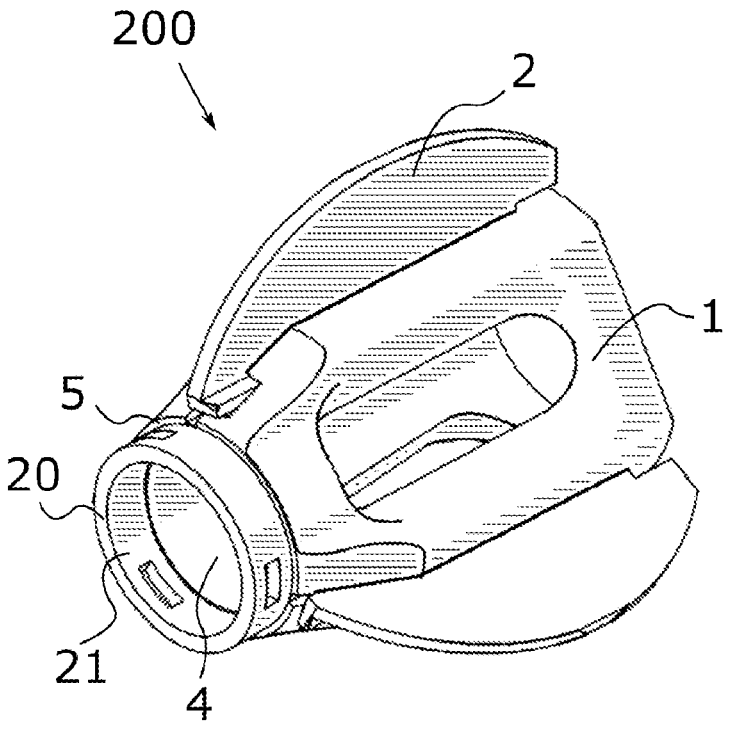
FIG. 5A is a perspective view showing a second embodiment of the present invention.
Figure 5B:
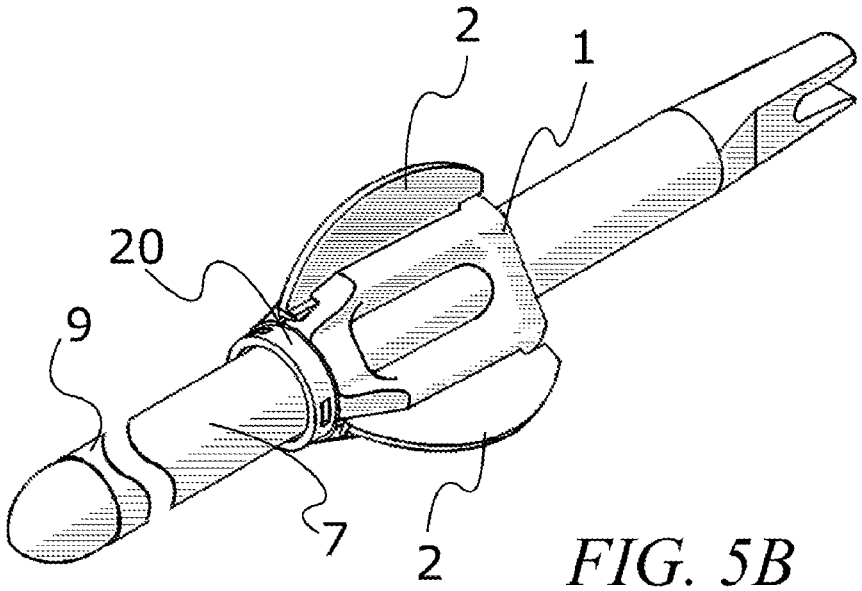
FIG. 5B is a perspective view showing the second embodiment of the present invention as installed to an arrow shaft.

Referring to FIGS. 5A-5B, in a preferred embodiment of the present invention, fletching apparatus 200 includes body 1, a plurality of fletches 2, and stopper 20. Preferably, hole 4 of body 1 and hole 21 of stopper 20 are equal in diameter. Preferably, stopper 20 is installed to arrow shaft 7 with an adhesive in order to prevent motion stopper 20 relative to arrow shaft 7 once the adhesive is set. Contact between body 1 leading edge 5 and stopper 20 prevents motion of body 1 in the direction toward arrow point end 9.

What is claimed:

1. An arrow fletching apparatus comprising:

a body, wherein said body is formed to removably dispose said apparatus to the shaft of an arrow, wherein said body is adapted to engage said shaft by a friction fit, said body comprises a plurality of protrusions formed radially along the length of said body wherein each said protrusion comprises a slot adapted to accept a fletch;

a plurality of fletches wherein each said fletch comprises a flanged base and a planar flight control surface wherein said base is oriented approximately perpendicular to said planar surface on at least one side of said planar surface.

2. The apparatus of claim 1 wherein a hole extending longitudinally through the center of said body has a diameter slightly larger than the outer diameter of an arrow shaft, said hole acts as a contact surface for said arrow shaft and provides a means for said body to be removably disposed to said arrow shaft.

3. The apparatus of claim 1 wherein said protrusion is oriented generally longitudinally with said body.

4. The apparatus of claim 1 wherein said slot is oriented generally longitudinally with said protrusion.

5. The apparatus of claim 1 wherein the cross section of said slot comprises a generally wide portion adapted to engage said base and a generally narrow portion adapted to engage said planar surface wherein said narrow portion is oriented outward, near the opening of said slot, and said wide portion is oriented inward, near the center of the cross section of said body.

6. The apparatus of claim 1 wherein said fletch is removably retained within said slot in the leading direction by a friction fit, said fletch is retained within said slot in the trailing direction by the termination of said slot into said protrusion.

7. An arrow fletching apparatus comprising:

a body formed to removably attach to the shaft of an arrow, wherein said body is adapted to engage said shaft by a friction fit, said body comprises a plurality of protrusions formed radially along the length of said body wherein each said protrusion comprises a slot adapted to accept a fletch;

a plurality of fletches wherein each said fletch comprises a flanged base and a planar flight control surface wherein said base is oriented approximately perpendicular to said planar surface on at least one side of said planar surface;

a stopper formed to attach to the shaft of an arrow.

8. The apparatus of claim 7 wherein a hole extending longitudinally through the center of said body has a diameter slightly larger than the outer diameter of an arrow shaft, said hole acts as a contact surface for said arrow shaft and provides a means for said body to be removably disposed to said arrow shaft.

9. The apparatus of claim 7 wherein said protrusion is oriented generally longitudinally with said body.

10. The apparatus of claim 7 wherein said slot is oriented generally longitudinally with said protrusion.

11. The apparatus of claim 7 wherein the cross section of said slot comprises a generally wide portion adapted to engage said base and a generally narrow portion adapted to engage said planar surface wherein said narrow portion is oriented outward, near the opening of said slot, and said wide portion is oriented inward, near the center of the cross section of said body.

12. The apparatus of claim 7 wherein said fletch is removably attached to said body wherein said base engages said slot by a friction fit, and the trailing edge of said fletch is held by the termination of said slot into said protrusion.

13. The apparatus of claim 7 wherein said stopper is irremovably attached to said shaft by means of an adhesive such as glue.

14. The apparatus of claim 7 wherein said stopper is positioned onto said arrow shaft before the leading edge of said body.

* * * * *